United States Patent [19]

Antos et al.

[11] Patent Number: 4,703,785

[45] Date of Patent: Nov. 3, 1987

[54] TANK FILL ASSIST

[75] Inventors: John M. Antos, Ann Arbor; John R. Selina, Farmington Hills, both of Mich.

[73] Assignee: Thetford Corporation, Ann Arbor, Mich.

[21] Appl. No.: 853,532

[22] Filed: Apr. 18, 1986

[51] Int. Cl.[4] ..... B65B 3/04

[52] U.S. Cl. ..... 141/326; 141/382; 141/383; 141/392; 222/530; 222/538; 248/79

[58] Field of Search ..... 141/279, 382–389, 141/285–310, 325, 326, 327; 222/538, 539, 530; 248/79, 75, 98, 369–381, 392

[56] References Cited

U.S. PATENT DOCUMENTS

| | | | |
|---|---|---|---|
| 2,398,828 | 4/1946 | Gray | 141/389 |
| 3,142,320 | 7/1964 | Olson | 222/539 |
| 3,181,745 | 5/1965 | Grobowski | 222/539 |
| 3,865,270 | 2/1975 | Peterson | 222/539 |
| 4,426,027 | 1/1984 | Maynard | 222/539 |

FOREIGN PATENT DOCUMENTS

| | | | |
|---|---|---|---|
| 643876 | 7/1962 | Canada | 222/538 |

*Primary Examiner*—Houston S. Bell, Jr.
*Attorney, Agent, or Firm*—Harness, Dickey & Pierce

[57] ABSTRACT

A tank fill assist for filling a tank or other equivalent volume from a remote source of liquid, for example filling a consumer product from a sink or bathroom faucet with fresh water. The fill assist is normally stowed within the interior of the tank. It is withdrawn for connection to a faucet for tank filling, and is then returned to stowed position after tank filling. The fill assist comprises standard flexible conduit with unique inlet and outlet fittings at opposite ends. The outlet fitting is disposed within the interior of the tank and is constructed and arranged to prevent accidental separation of the fill assist from the tank when the conduit is withdrawn from the tank yet to allow passage through the fill opening when it is intended to either join or separate the fill assist to or from the tank. The inlet fitting is of thermoplastic rubber and can be fitted over the outlets of typical sink and bathroom faucets. A retainer is disposed around the flexible conduit and is axially captured on the conduit between the inlet and outlet fittings. The retainer forms a recepticle within which the inlet fittings nest when the fill assist is stowed. The retainer in turn nests within the fill opening. The retainer comprises apertures in its sidewall which provide an alternate fill patch into the tank which is independent of the fill path through the conduit. The retainer seats on partial internal screw threads formed on the inner wall of the fill opening so that the usual closure cap which has locking tabs which engage the partial screw threads can be screwed onto and off the fill opening in the usual manner without interference from the stowed fill assist.

35 Claims, 19 Drawing Figures

TANK FILL ASSIST

BACKGROUND AND SUMMARY OF THE INVENTION

This invention relates generally to apparatus which facilitates the filling of a liquid-carrying tank. More specifically it relates to a tank fill assist comprising a flexible conduit which is normally stowed within the interior of the tank, which is withdrawn through a fill opening of the tank to connect to a source of fill liquid remote from the tank opening when the tank is to be filled, and which is returned to stowage within the tank's interior after filling. The disclosed embodiment of the invention is particularly adapted for filling a tank with fresh water from the faucet.

Certain consumer products comprise tanks, or other equivalent volumes, which are required to be filled with fresh water. Such products may be nothing more than water tanks alone, or they may be products which are recognized as other than water tanks, but which have water tanks incorporated into them. An example of a consumer product of the latter type would be a fresh water flush portable toilet which contains an integral fresh water storage chamber for a self-contained supply of fresh water for use in flushing of the toilet.

While many small tanks can be filled from almost any sink faucet simply by placement under the faucet, larger products cannot be filled as conveniently. For example, the fresh water storage chamber of a typical fresh water flush portable toilet cannot be filled directly from the usual kitchen or bathroom sink faucet because the toilet's size and shape in relation to the usual kitchen or bathroom sink basin prevent the water chamber's fill opening from being disposed directly beneath the faucet's outlet. While some products can be manipulated to place their fill openings below the faucet outlet, the orientation is often at an angle so that the product can at most be only partially filled. If use of a standard household hose is contemplated, such faucets typically lack a threaded outlet to which such a hose can be directly attached. The possibility of using a hose to fill a tank at the usual home bathroom or kitchen sink faucet is therefore unlikely unless the homeowner possesses a special adapter for connecting the hose fitting to the faucet. At that, most standard home hoses are of significant lengths, 25 foot, 50 foot and 100 foot lengths being common, so that carrying such a hose into the house is properly deemed an inconvenience. Accordingly, use of hose to fill a tank from a kitchen or bathroom sink faucet is considered improbable, and if attempted, somewhat of a nuisance.

Complete filling of such consumer products from faucets has heretofore depended upon either the availability of a faucet under which the fill opening can be directly placed, or the availability of suitably threaded faucet outlet, or suitable adapter, for attachment of a standard household hose. To the extent that suitable faucet installations exist, they are usually either indoors in basements or laundry rooms, or else outdoors. Finding a hose, and then taking it and the consumer product to laundry room or basement for filling, involves extra effort. Need for an adapter is an added complication. Likewise having to go outside for filling may also be considered an inconvenience, and indeed outdoor faucets are usually shut off in the winter months in colder climates so that filling during this time may have to be done indoors.

While many consumer products which involve periodic water filling are considered recreational or leisure products which are used for the most part outdoors in warmer weather, outdoor filling may still be considered an inconvenience. For example, a hose may still be required. Even at certain sites which permit a product to be placed directly underneath a faucet and filled without a hose, it is often necessary for the individual to support the product underneath the faucet while also operating the faucet. Where the product has a significant capacity, it can become tiresome to hold the increasing weight during the fill, and it may become difficult to accurately maintain the alignment of the fill opening with the faucet outlet. Consequently, water may spray or spill onto the individual and the immediate surroundings. If this were to happen inside the home, it would certainly be considered undesirable.

Moreover, some types of faucets have spring-loaded operators whereby in order to maintain a flow of water from the faucet the individual must continuously press on the operator. Where the individual filling a tank also has to support a tank beneath the faucet or hold the end of a hose in the tank, the task is further complicated by this particular type of faucet mechanism.

A survey of prior art has developed references showing self-contained conduits which are stowed within a tank or container and extended for use. Examples appear in U.S. Pat. Nos. 2,198,933; 2,723,056; 2,789,734; 2,805,001; 3,168,248; and 4,450,966. Such conduits appear intended for the most part to facilitate emptying of the contents of the associated tanks, or containers, rather than filling, and U.S. Pat. No. 3,168,248 does not even involve filling or emptying of the container within which the conduit is stowed. Other patents developed depict usage of fill assist devices and reference is made to U.S. Pat. Nos. 747,052 and 2,002,592.

The present invention is directed broadly to a tank fill assist which can improve the convenience of filling products of the types described above with fresh water.

One important advantage of the invention is that the tank fill assist is normally stowed within the tank itself; when the tank is to be filled, the fill assist is extended from the tank and cooperatively associated with a faucet. Upon completion of filling, the fill assist is inserted back into the tank. Therefore the fill assist goes with the tank and is always available for use.

While the principles of the invention are not necessarily limited to any particular length for the tank fill assist, the disclosed embodiment comprises a length of conduit which is suited for most filling uses, and is much shorter than the lengths of the standard hoses described above.

One constructional feature of the tank fill assist relates to a means for resisting complete separation from the tank. While the fill assist can be intentionally separated from the tank, accidental separation is essentially ruled out by this constructional feature. This feature allows the fill assist to be easily initially inserted into the tank, yet if release from the tank is necessary, it can be manipulated for intentially desired separation of the fill assist from the tank.

Still another feature of the invention relates to a retainer via which the tank fill assist is cooperatively associated with a fill opening of the tank. When the tank fill assist is in the stowed position, an inlet fitting on the conduit nests within the retainer, and the retainer itself nests within the fill opening. The organization and arrangement is such that there is a coaction between the fill opening, the retainer, the conduit, and the inlet fitting which yields significant benefits.

One of these is that the retainer can be supported on internal partial screw threads formed in the fill opening while permitting the usual closure cap for the fill opening to be screwed on and off in the usual manner without interference.

A further benefit is that an additional fill path is provided through the retainer which is independent of the fill path through the conduit. This additional fill path is present with the retainer nested in the fill opening, and in the preferred embodiment of the invention, is independent of whether the inlet fitting on the conduit is nested in the retainer (i.e. the tank fill assist in the stowed position) or whether the conduit has been extended from the tank. Thus, when the tank fill assist of the present invention is cooperatively associated with the fill opening, the tank can still be filled without use of the tank fill assist by simply introducing water directly into the fill opening, for example by placing it directly beneath a faucet or pouring from another container.

Furthermore a fill assist embodying principles of the invention can be fabricated using conventional fabrication procedures. The disclosed preferred embodiment comprises the use of standard flexible tubular walled conduit and several molded parts.

A molded plastic outlet fitting is inserted into one end of the flexible conduit, and it is this outlet fitting which acts to resist accidental separation of the fill assist from the tank when the conduit is drawn from the tank.

The inlet fitting is joined to the opposite end of the conduit through a molded plastic union. The inlet fitting is a soft, somewhat pliable, one piece molded member which can be pushed onto the outlet of most home faucets. It includes an inwardly directed lip at its inlet end which deflects when the fitting is pushed onto a faucet and which maintains a satisfactory seal with respect to the faucet. After filling the fitting is removed simply by pulling it off the faucet, the lip having a sufficiently resilient character allowing such separation to take place without excessive force. The inlet fitting possesses further uniqueness in that it comprises a composition consisting of a mixture of synthetic rubber and plastic.

The retainer is a molded plastic piece which fits around the tubular walled flexible conduit. The retainer has two integral apertures in its sidewall diametrically opposite each other. It is through these apertures that water can be introduced independent of the conduit. One edge portion of each aperture defines a corresponding segment of a circular ring. These ring segments are on diametrically opposite sides of the retainer and serve to support the retainer on the partial internal screw threads of the fill opening which are diametrically opposite each other on the internal wall of the fill opening. A transverse end wall of the retainer has a hole with a diameter noticeably larger than the outside diameter of the tubular walled conduit so that the tubular walled conduit has a free sliding fit with respect to the retainer. The retainer is however axially captured on the conduit between the two end fittings.

Because of its attributes the tank fill assist can be sold as a separate accessory kit for use with consumer products which are already in service. However the tank fill assist can be sold with the product at time of original purchase.

While the invention promotes convenience of use for all users, it may afford a more noticeable improvement in convenience for women and children.

The foregoing features, advantages, and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
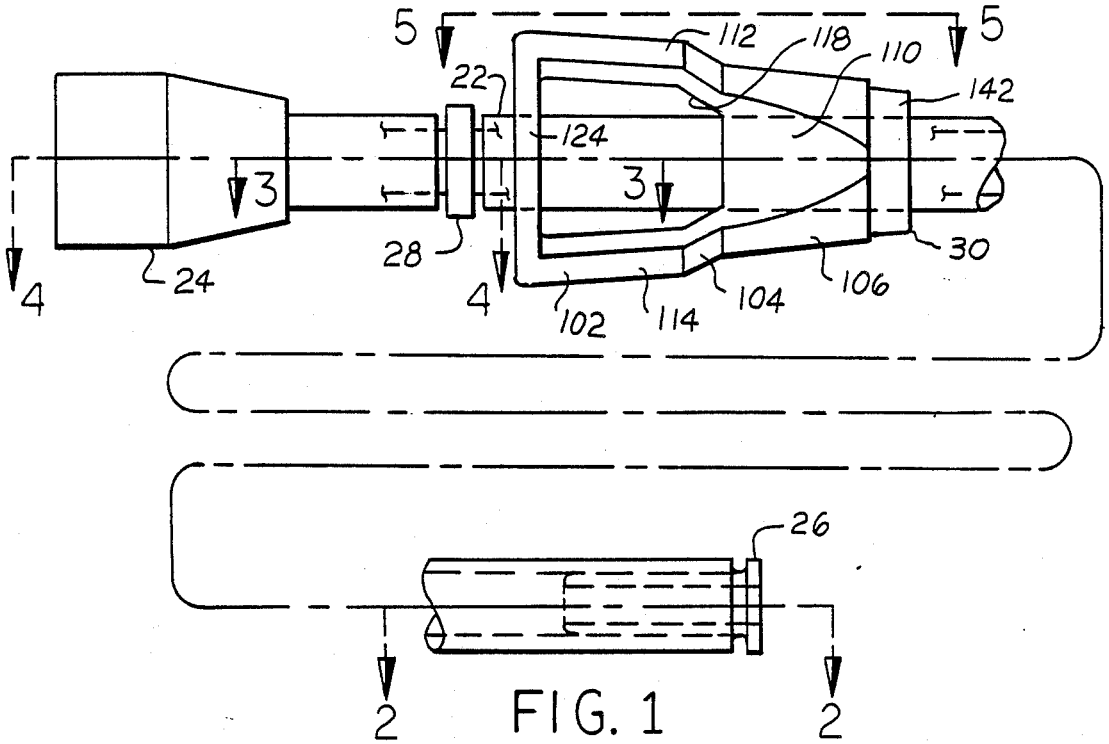
FIG. 1 is a side view of a tank fill assist embodying principles of the present invention.

FIG. 1 illustrates an exemplary preferred embodiment of tank fill assist 20 in accordance with principles of the present invention. The tank fill assist comprises a given length of flexible tubular conduit 22 having an inlet fitting 24 attached to its inlet end and an outlet fitting 26 attached to its outlet end. The attachment of inlet fitting 24 to the inlet end of conduit 22 is via a union 28 while outlet fitting 26 attaches directly to the outlet end of conduit 22. A retainer 30 is disposed on conduit 22 and is axially captured between the inlet and outlet fittings 24, 26.

Figure 2:
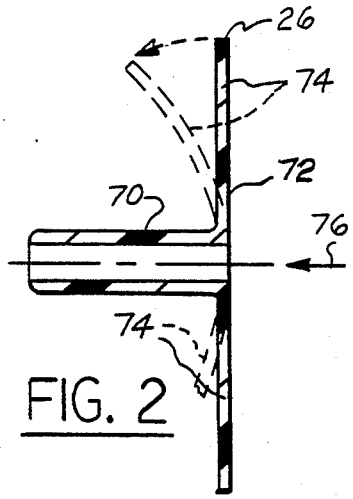
FIG. 2 is a longitudinal cross sectional view through one of the component parts of the tank fill assist of FIG. 1 shown by itself and taken generally in the direction of arrows 2—2 in FIG. 1.
Figure 3:
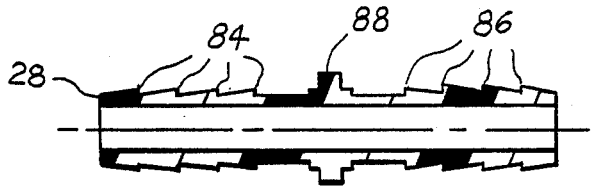
FIG. 3 is a longitudinal cross sectional view through another of the component parts of the tank fill assist of FIG. 1 shown by itself and taken generally in the direction of arrows 3—3 in FIG. 1.
Figure 4:
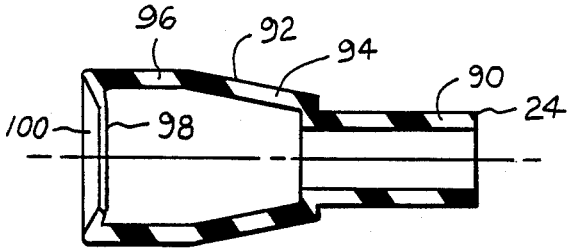
FIG. 4 is a longitudinal cross sectional view through yet another of the component parts of the tank fill assist of FIG. 1 shown by itself and taken substantially in the direction of arrows 4—4 in FIG. 1.
Figure 5:
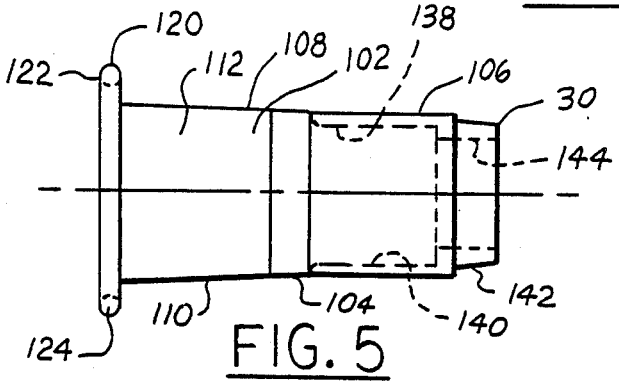
FIG. 5 is a view of still another of the component parts of the tank fill assist of FIG. 1 shown by itself and taken generally in the direction of arrows 5—5 in FIG. 1.

FIG. 2 shows additional detail of outlet fitting 26, FIG. 3 additional detail of union 28, FIG. 4 additional detail of inlet fitting 24, and FIG. 5 additional detail of retainer 30. The illustrated embodiment of tank fill assist 20 therefore comprises a total of five pieces in assembled relationship.

Conduit 22 is standard circular walled conduit of any suitable material. While principles of the invention in their broader aspects are not necessarily to be limited to any particular material or dimensions, a preferred material for conduit 22 is vinyl (polyvinylchloride) tubing having 80 durometer hardness. A preferred size is nominal half inch tubing with an inside diameter 0.380 inches and consequent 0.060 inch wall. As will become more apparent from the ensuing description, conduit 22 has a length on the order of four feet.

Union 28, retainer 30, and outlet fitting 26 are molded plastic parts. Preferred materials are: for union 28, nylon; and for retainer 30 and outlet fitting 26, a polyester, such as is sold commercially under the brand name Valox.

Inlet fitting 24 is also a molded part, but it possesses a unique character by virtue of a preferred fabrication as thermoplastic rubber, a mixture of a thermoplastic and a rubber. A preferred formulation is a mixture of polypropylene and synthetic rubber having 64 durometer hardness which, while giving the inlet fitting a soft and somewhat pliable character, will tend to return to the molded shape when deformed.

Before describing greater detail of the component parts, both individually and in assembled relationship, an exemplary use of tank fill assist 20 will be described with reference to FIG. 6. That Figure shows a typical sink installation 40 which may be found in a household kitchen or bathroom. It includes a sink basin 42 whose upper rim is disposed on the order of 3 feet above the level of the floor 44. A faucet assembly 46 is also mounted on the sink and has a spout 48 whose outlet is directly toward sink basin 42. Particular details of faucet assembly 46 are for the most part inconsequential insofar as use of the present invention is concerned because inlet fitting 24 is adapted for use with most conventional faucet outlets which would be found in bathroom and kitchen sinks.

Figure 6:
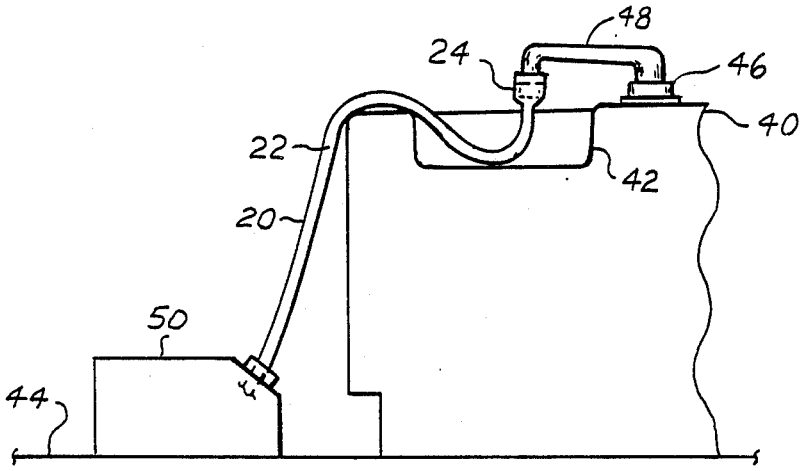
FIG. 6 is a side elevational view illustrating a representative usage of the tank fill assist of FIG. 1 in filling of a tank.

FIG. 6 shows tank fill assist 20 in use filling a product 50 from spout 48. Product 50 is intended to be representative of many different consumer products which require filling with fresh water. The two examples mentioned earlier, namely a water tank and the water chamber of a portable toilet are representative. The particular product 50 illustrated herein is the upper seat section of a two-piece fresh water flush portable toilet. Such a seat section corprises a bowl which is surrounded on its side by an internal fresh water storage chamber. The chamber is filled via a fill opening 52, and it is through fill opening 52 that tank fill assist 20 passes.

Convenience in filling of the product 50 is promoted by allowing it to rest on floor 44 while it is being filled. Thus the length of conduit 22 is sufficient to allow the fill assist to extend from fill opening 52 upwardly over the edge of the sink counter, to drape down into the sink basin, and then to extend upwardly into connection with faucet spout 48. When the faucet is turned on, water flows from the faucet through fill assist 20 and into the water chamber. An individual filling the product can monitor the level of fill either visually or by sticking a finger through fill opening 52 to sense when the fill level has risen to near full.

The fill assist enables a product 50 to be filled from the typical home kitchen or bathroom sink in a manner which, with due care on the part of the individual filling it, will be without spilling or spraying onto the floor or surroundings. Because it is unnecessary for the individual to support the weight of product 50 while it is being filled, the filling procedure is not burdensome. In other words the procedure can be conducted easily, quickly, and neatly.

Figure 14:
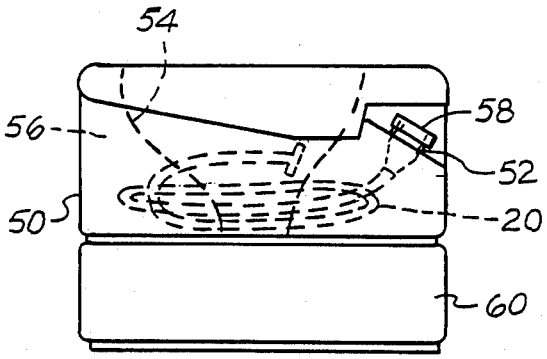
FIGS. 14 and 15 are side elevational and top plan views respectively of a consumer product containing a water tank with which the tank fill assist of FIG. 1 is cooperatively associated, the views of FIGS. 14 and 15 depicting the tank fill assist in stowed position.
Figure 15:
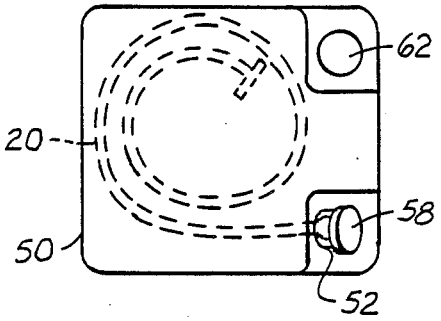
Figure 11:
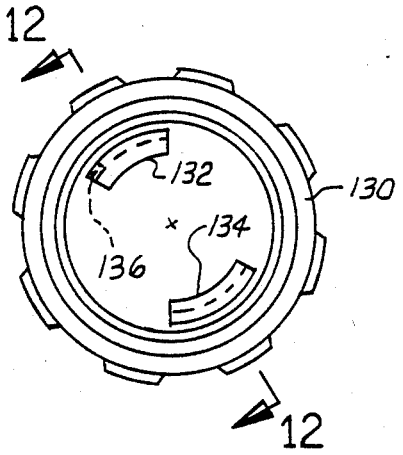
Figure 12:
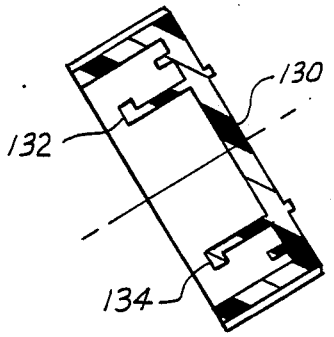
FIG. 12 is a cross sectional view taken in the direction of arrows 12—12 in FIG. 11.

After filling has been completed, the tank fill assist is stowed by inserting it back into the water storage chamber through fill opening 52. FIGS. 14 and 15 illustrate a representative stowed position in the upper seat section of a toilet wherein the bowl 54 is surrounded by the water chamber 56 so that the water chamber, as viewed in FIG. 15, possesses a generally annular shape. The illustrated embodiment shows fill opening 52 to be located near a corner in the top wall of the seat section. When the fill assist is stowed within the flush water storage chamber it will tend to coil within chamber 56 around the outside of bowl 54 in several convolutions as shown. It is to be appreciated that this illustration is merely representative and does not necessarily constitute an exact shape for the convolutions which a stowed fill assist will assume. By making the fill assist stowable in the chamber, it is always available for use and there is no need to search for a hose when the chamber is to be filled from a sink faucet.

When the tank fill assist has been stowed within chamber 56, fill inlet 52 is closed by a closure cap 58. As will become more apparent from the ensuing description, the tank fill assist does not interfere with the attachment and removal of the closure cap.

After the seat section's chamber 56 has been filled to a desired level with fresh water, tank fill assist 20 stowed, and closure cap 58 reattached to fill opening 52, the seat section is reattached atop a mating holding tank section 60, as seen in FIG. 14, the seat and holding tank sections forming the complete portable toilet. The seat section contains a pump 62 which is operable to draw water from chamber 56 and introduce it into bowl 54. The bowl has a bottom outlet which aligns with an inlet opening in the top wall of the holding tank. A flush valve controls this opening and when it is opened, the contents of the bowl fall into the holding tank. When the holding tank section is separated from the seat section, its waste contents can be dumped at an appropriate waste disposal facility.

While outlet fitting 26 is so named because it forms the outlet from the tank fill assist when the tank fill assist is being used to fill a chamber or tank, its principal purpose is to retain the outlet of the tank fill assist 22 within the associated chamber or tank. Outlet fitting 26 is shown in detail in FIG. 2 to comprise a main body 70 which has a circular tubular shape. Integrally formed with main body 70 at one end thereof is a flange structure, 72 generally. This flange structure comprises a pair of flanges 74 which project radially from diametrically opposite sides of main body 70. As viewed from the direction of arrow 76 in FIG. 2, the two flanges 74 cooperatively have an overall rectangular shape with respect to which main body 70 is geometrically centered. The full size bristol board drawing accompanying this patent application depicts the individual parts essentially at full scale in FIGS. 1–5. The actual size of the rectangular shape formed by the two flanges 74 as viewed in the direction of arrow 76 is 3 inches by ½ inch. The thickness as viewed in FIG. 2 is 0.070 inches and the overall axial length of outlet fitting 26 is 1.27 inches. The end surface 78 of flange structure 72 is flat. While the opposite surface of the flange structure is generally flat also, it joins with the outside wall of main body 70 in a radius of 0.05 inches. This endows each flange 74 with a preferred direction of flexing about main body 70 as represented by the two broken line positions for the flanges in FIG. 2. While the inherent characteristics of the preferred material in this specific design permit some flexing of the flanges in the opposite sense from that illustrated in FIG. 2, the flanges definitely possess a preferred flexing in the direction illustrated. This preferred direction of flexing is useful in passing of the outlet fitting through the fill opening, as will become more apparent from ensuing description.

The outside diameter (OD) of main body 70 is sized in relation to the inside diameter (ID) of conduit 22 such that the outlet fitting will be self-retaining on the outlet end of the conduit by virtue of inserting main body 70 into the outlet end of conduit 22, as shown in FIG. 1. Thus the ID of the outlet fitting forms the final segment of the flow path through the fill assist conduit.

Figure 7:
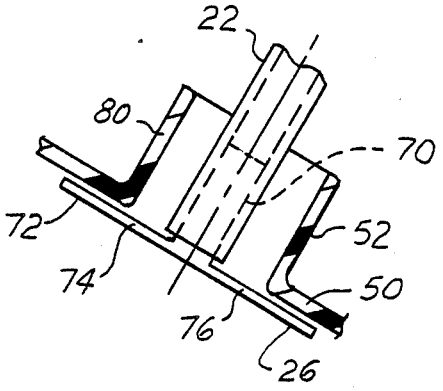
FIG. 7 is a fragmentary cross sectional view taken generally in circle 7 in FIG. 6, and enlarged.
Figure 8:
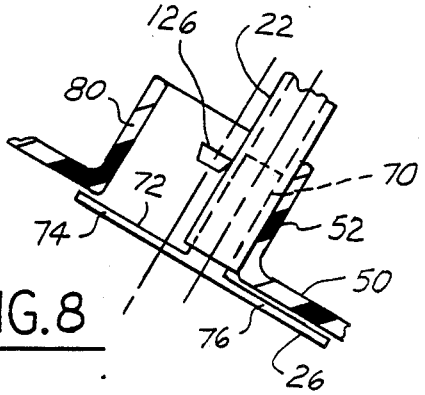
FIG. 8 is a view similar to FIG. 7 illustrating an alternate position.

FIGS. 7 and 8 illustrate flange structure 72 performing the retention function on the tank. The illustrated fill opening 52 comprises a circular flange 80 formed integrally with and projecting away from the wall of the tank. The maximum diameter of flange structure 72 exceeds the ID of the fill opening such that the retention function is performed not only as shown in FIG. 7 for concentricity of conduit 22 with the fill opening, but also for all possible eccentricities of the conduit within the fill opening, including extreme eccentricity where the wall of conduit 22 is disposed against the inside wall of the fill opening. In FIG. 8 it can be seen that both flanges bear against the wall of the tank. The conditions of FIG. 7 and 8 will occur when the tank fill assist is withdrawn to its maximum extent from the tank. The interference provided by the flanges with the wall of the tank around the fill opening provides a stop which prevents accidental separation of the fill assist from the tank at maximum withdrawal. Attempts to pull the fill assist further outwardly when the flange structure is engaged with the tank wall as shown in FIGS. 7 and 8 will be in a sense which is opposite to the preferred direction of flexing of the flange structure on main body 70. Some flexing in the non-preferred sense may take place but the typical pulling forces on the fill assist will be insufficient to flex the flanges enough to clear the wall of the tank. Hence, the flanges present sufficient resistance that the possibility of accidental separation of the fill assist from the tank is essentially ruled out.

While outlet fitting 26 essentially precludes accidental separation after its insertion into the tank, the preferred direction of flange flexing enables it to pass through the fill opening. This will initially occur when the tank fill assist is first assembled to the tank by pushing the outlet fitting through the fill opening. After the deflected flanges have cleared the fill opening, they will relax toward their normal position (FIGS. 1 and 2) where they will function to prevent accidental separation, as described. It is also possible to manipulate the flange structure, after its insertion past the fill opening, so that the flange structure is released from an interference relationship with the wall of the tank. This will allow the fitting to pass back through the fill opening and thereby separate the fill assist from the tank. Thus the dimensions of the flange structure are sufficiently large to assume a relationship to the fill opening as in FIG. 8, but they are preferably not so large that the flange structure cannot be flexed by external manipulation through the fill opening to enable the fill assist to be separated from the tank. By way of example the fill opening depicted in FIG. 7 and 8 has an ID of 1.65inch and a length of 0.75 inch.

Union 28 is essentially a tubular piece with a series circular serrations 84, 86 at each end and a circular flange 88 in the middle. Each series of serrations points away from flange 88 and the serrations are sized for press fit reception of the inlet end of conduit 22 on one end and the press fit reception of inlet fitting 24 on the other. The serrations engage the inside walls of the conduit and the inlet fitting respectively in a manner which prevents leakage for the relatively low fluid pressure which will act on the connections during normal use, and they are sufficiently secure to resist the expected forces encountered during withdrawal of the fill assist from the tank.

Inlet fitting 24 has an overall tubular shape. It comprises a circular tubular neck 90 which fits onto one series of serrations of union 28. It has an enlarged body 92 extending from neck 90 and the shape illustrated comprises a frusto-conically tapered sidewall segment 94 which merges into a straight cylindrical sidewall segment 96. The end of segment 96 opposite tapered wall section 94 constitutes the inlet end of inlet fitting 24 and it includes a radially inwardly directed, circumferentially continuous lip 98. Lip 98 has a tapered shape as viewed in radial cross section. It also is canted radially inwardly at an acute angle to sidewall segment 96. As such, it presents a concave frusto-conically tapered surface 100 at the inlet end.

As explained earlier, the preferred material of inlet fitting 24 has a soft and pliable but resilient character. This enables the inlet end of fitting 24 to be pressed over the outlet of a faucet. The particular design shown is adapted to fit most standard kitchen and bathroom sink faucets. The ID across the radially inner edge of lip 98 is less than the OD of the typical faucet outlet. The ID across sidewall segment 96 is slightly larger. Therefore when the inlet fitting is pressed over a faucet outlet, lip 98 will deflect to form a sealing engagement around the outside of the faucet outlet if the faucet OD is slightly larger than the ID across the lip but less than the ID across the sidewall segment 96. For a somewhat larger OD for the faucet outlet, the lip will increasingly deflect, and for even larger faucet ODs the sidewall of the fitting will circumferentially expand. Thus the inlet fitting is adapted to mate with a range of faucet sizes. By way of example the dimension across the ID of lip 98 in a preferred embodiment is nominally 0.69 inches and the ID across sidewall section 100 is 0.91 inches nominally.

Retainer 30 serves several purposes. One is to retain the inlet fitting 24 within fill opening 52 when the tank fill assist is stowed. Another is to provide a fill path through inlet opening 52 which is independent of the fill path through conduit 22. The preferred embodiment of retainer 30 is also advantageous in that it supports the stowed inlet fitting in a manner which allows the tank fill assist to be used for certain consumer products which are already in service without modification of those products. In those products the existing closure cap and its means of attachment can continue to be used without the tank fill assist creating any interference. In certain portable toilets the fill opening to the fresh water tank comprises a pair of partial screw threads on diametrically opposite sides of the ID of the fill opening. The associated closure cap comprises locking tabs which move into and out of engagement with these partial screw threads when the cap is placed on the fill opening and rotated. The illustrated retainer seats on the outwardly facing surfaces of these partial screw threads yet provides clearance which allows the locking tabs of the closure cap to engage and disengage the inwardly facing surfaces of the partial screw threads. Details of the retainer and how these attributes are embodied will now be explained with reference to FIGS. 1, 5, and 9–13.

Retainer 30 comprises a generally tubular sidewall which possesses a somewhat tapered shape as viewed in FIG. 1. The taper narrows in the direction from inlet fitting 24 toward outlet fitting 26. The retainer sidewall may be considered to comprise several sections, three consecutive ones of which are a larger diameter section 102, a more sharply tapered shoulder section 104 and a smaller diameter section 106. These sections 102, 104, 106 do not have fully circular transverse cross sectional shapes; rather they have flattened zones 108, 110 on diametrically opposite sides, as best seen in FIG. 5. For all three sections 102, 104, 106, the flattened zones 108, 110 circumferentially separate diametrically opposite zones 112, 114 which have circularly contoured cross sections, and consequently the sidewall of the retainer comprises the four zones 108, 110, 112, 114. The flattened zones 108, 110 are not fully parallel with each other. As shown by FIG. 5, they are exactly parallel with each other in section 106; in sections 102, 104, they are more or less parallel with the taper of section 102.

Identical apertures 116, 118 are provided in the flattened zones 108, 110. The aperture shape is best seen in FIG. 1 where it is shown generally coextensive with the sections 102, 104.

The retainer's end immediately adjacent apertures 116, 118 is in the form of a circular ring 120. While the ring merges with the circularly contoured zones 112, 114 in section 102, it has circularly contoured ring segments 122, 124 which span the flattened zones 108, 110 adjacent apertures 116. 188. These ring segments 122, 124 serve to support retainer 30 on the fill opening's partial internal screw threads referred to above.

Figure 9:
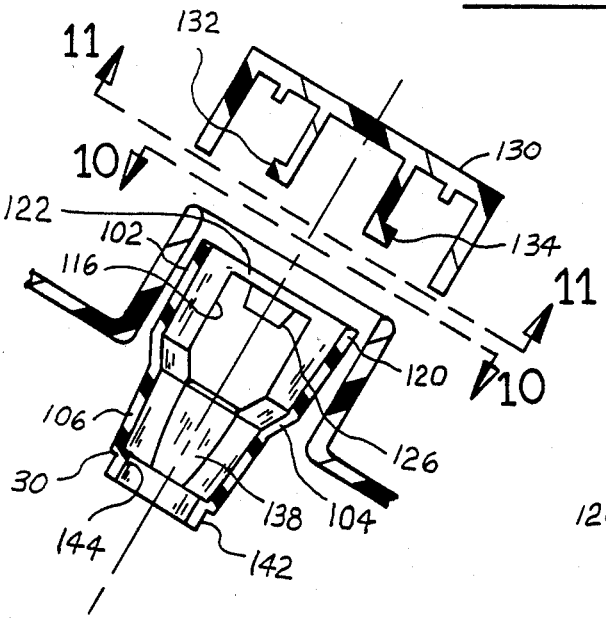
FIG. 9 is a view similar to FIG. 7 but of other component parts for illustrating particular relationships between those component parts, and on a slightly larger scale.
Figure 10:
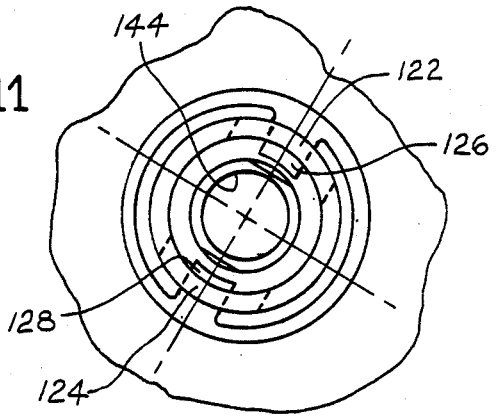
FIGS. 10 and 11 are views taken generally in the direction of arrows 10—10 and 11—11 respectively in FIG. 9.

These partial screw threads 126, 128 are seen in FIGS. 9 and 10, and in each of these two views, retainer 30 is shown by itself, conduit 22 and inlet fitting 24 being omitted for purposes of clarity. A closure cap 130 for the fill opening is also shown, and it comprises locking tabs 132, 134 via which it screws onto and off of the partial screw threads 126, 128.

As can be seen in FIG. 10 the partial screw threads 126, 128 project radially inwardly of the fill opening's internal wall surface a sufficient distance that their radially inner edge are disposed more radially inwardly than the ring segments 122, 124 of retainer 30. The ID of the retainer across ring 120 is larger than the OD across the free ends of locking tabs 132, 134 of closure cap 130, as can be seen from consideration of FIG. 9. The locking tabs comprise axial projections which extend from the inside of the end wall of closure cap 130 and shorter radially outwardly directed portions at the free ends of the axial projections. With the closure cap circumferentially aligned in the manner shown in FIG. 9 in relation to the fill opening, the closure cap may be moved axially toward and onto the fill opening so that the free ends of the locking tabs are disposed axially beyond the circular ring segments 122, 124. With the locking tabs so disposed, rotation of the cap to the FIG. 10 position will be effective to interengage the radial projections of the locking tabs with the partial screw threads 126, 128. As can be appreciated from consideration of the drawing figures, the amount of rotation effective to cause this to happen will be somewhat on the order of a quarter turn. Thus the closure cap screws onto and off of the fill opening in the usual manner without interference by the seated retainer 30. Either one or both the partial screw threads and the radial projections of the locking tabs may have inclined ramp surfaces whereby upon rotation of the cap toward the locking position, a tightening occurs by virtue of camming action. In the locked position of the cap the free circular end edge of the fill opening flange abuts the inside of the closure cap wall; with use of conventional plastic materials a satisfactory seal results for this particular application without the use of a separate sealing gasket. A stop 136 may be incorporated into a locking tab to limit the extent of circumferential rotation of the cap by abutment with the edge of the corresponding partial screw thread when the cap is locked.

Figure 13:
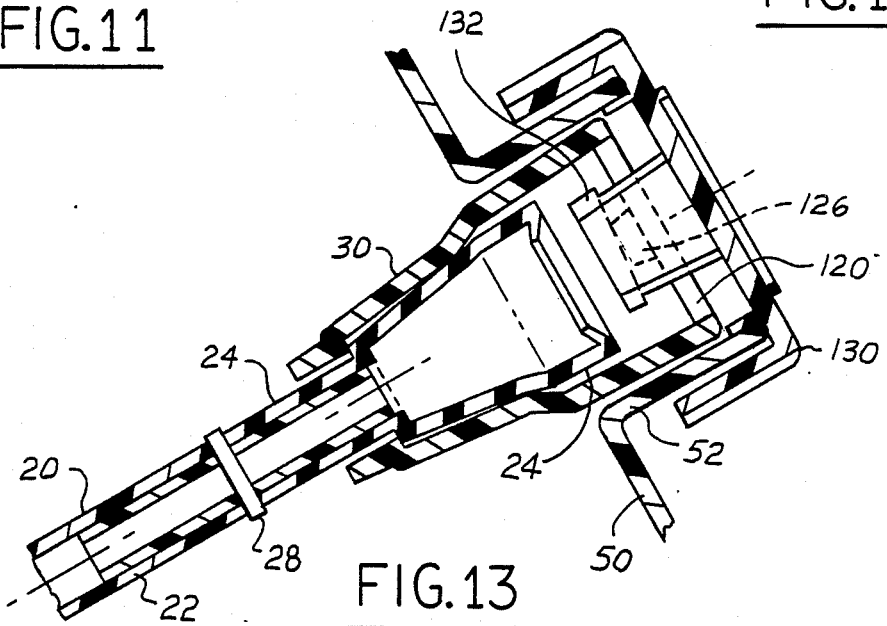
FIG. 13 is a cross sectional view similar to FIG. 9 but taken at 90° from the view of FIG. 9 and showing various component parts in stored position, and on a slightly larger scale.

As can be seen in FIG. 13 inlet fitting 24 is nested within retainer 30 when fill assist 20 is in its stowed position. In this nested position the inlet end of the inlet fitting is disposed inwardly beyond the free ends of the closure cap's locking tabs so that the inlet fitting, like retainer 30, does not interfere with attachment and removal of the closure cap to and from the fill opening.

In this nested relationship the soft, pliable, resilient character of the inlet fitting is used to advantage. The internal surface of sidewall section 106 is not fully circular, and so it has generally flat internal surfaces 138, 140 on diametrically opposite sides which are generally coextensive with the flattened zones 108, 110. When the inlet fitting is being moved from an extended position into nested position within the retainer, the extent of insertion into the retainer is limited by the abutment of the segment 94 of the inlet fitting with the edges of the flattened surfaces 138, 140 just axially beyond where the apertures 116, 118 terminate. When contact initially occurs, the inlet end of inlet fitting 24 has been inserted axially into the retainer just barely beyond the ring segments 122, 124. This amount of axial insertion is insufficient to avoid interference with the locking tabs of the closure cap when the closure cap is placed onto the fill opening. However, because of the character of the material of inlet fitting 24, it can be pushed to a fully nested position illustrated in FIG. 15 with the flattened inside wall surfaces 138, 140 of the retainer serving to slightly deform wall segment 94 of the inlet fitting as the latter is increasingly pushed into the retainer. Not only does this provide the necessary clearance for the locking tabs of the cap, but it also means that the inlet fitting is securely held by the retainer.

The retainer further includes an end wall 142 at its axially inner end which contains a circular hole 144. This hole is of noticeably larger diameter than the OD of conduit 22 and therefore the retainer can freely pass along the full length of the conduit although it is axially captured on the conduit between the inlet and the outlet fittings.

When the tank fill assist is withdrawn for use it will typically be retainer 30 which is removed from the fill opening 52 and this in turn serves to pull the conduit along with it. After a sufficient length of conduit has been withdrawn in this manner, the retainer is pushed out of engagement with inlet fitting 24, sliding partially along the conduit. The inlet fitting can then be placed onto the faucet outlet. Stowage may take place in the opposite manner but it is possible to seat the retainer on the fill opening and then pass the conduit back into the tank through the retainer until the inlet fitting is nested within the seated retainer.

Although the drawing figure illustrates fill opening 52 to be at an inclined angle to the vertical, the tank fill assist can be used with fill openings which are vertical or that are at other angles to vertical. In the portable toilet application which is illustrated by FIGS. 6, 14, 15, the presence of the opening at the corner of the tank as advantageous because it provides a certain guidance to form the convolutions, as shown in FIGS. 14 and 15, when the fill assist is being stowed. Likewise the shape of outlet fitting 26 has proven quite satisfactory, not only for preventing accidental separation as noted, but also for guidance of the conduit around the bowl in the illustrated portable toilet application.

Figure 16:
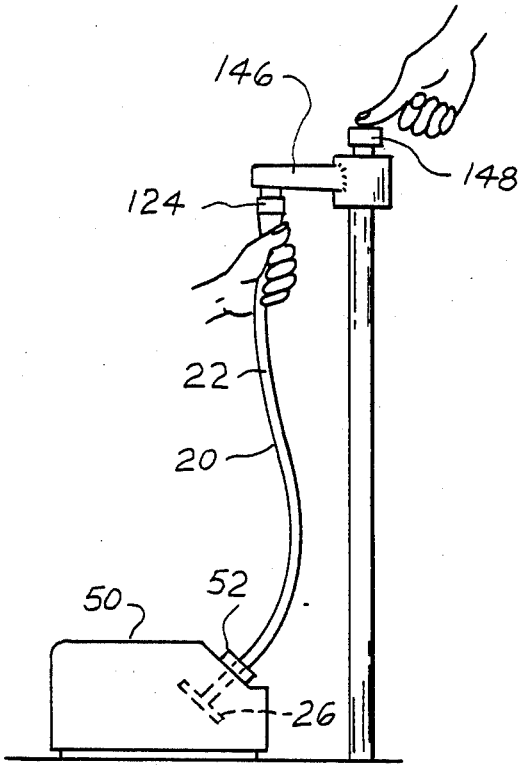
FIG. 16 is a side elevational view illustrating use of the tank fill assist of FIG. 1 in filling of a tank from another type of faucet.

FIG. 16 illustrates another type of filling which further demonstrates the advantages of the invention. This faucet 146 is a free standing one of the type which has a spring loaded operator 148. The spring loaded operator must continue to be depressed to cause water to flow from the faucet. With the present invention a tank 50 to be filled can be placed on ground or floor adjacent the faucet. The inlet fitting 24 is attached to the faucet outlet as shown, and then the individual is free to depress the springloaded operator for filling the tank. Although this figure shows a hand engaging the inlet fitting, it is to be appreciated that the inlet fitting is intended to be self-retaining on faucets and therefore in virtually all instances will not require manual support to maintain engagement. However if for some reason the inlet fitting could not be so engaged with a faucet, it could be held by one hand and the faucet still operated by the other hand.

Although FIGS. 6 and 16 have illustrated the product 50 being filled by withdrawing the tank fill assist conduit from the tank, connecting inlet fitting 24 to a faucet, and then filling the tank through the extended conduit 22, the organization and arrangement of retainer 30 and inlet fitting 24 in relation to each other and to fill opening 52 nonetheless allows the tank to be filled if the tank fill assist remains stowed. In other words after the closure cap has been removed, the tank can still be filled by other procedures, such as placing the fill opening directly beneath the faucet outlet or via a hose whose outlet is aimed into the fill opening or by pouring from another container. While the presence of the stowed fill assist will obviously present a certain obstruction to flow into the tank via the fill opening, there is sufficient clearance between the nested inlet fitting and the retainer that water can pass through apertures 116, 118 and into the interior of the tank, and this provides a flow path which is independent of the flow path conduit 22. Thus if the user of a product 50 should not want to use the tank fill assist he or she may still fill the tank in the manner just described and this may be an appropriate way to fill the tank at certain times. While the tank can be filled as just described while the fill assist remains stowed, it can also be filled through this alternate path with conduit 22 extended and with retainer 30 either within or out of the fill opening.

In the described use, the fill assist may have a length of about four feet. It is fully contemplated that useful tank fill assists embodying principles of the invention may have either longer or shorter lengths; however, for the most part these lengths will be noticeably shorter than the standard minimum 25 foot length of conventional household water hose.

Figure 18:
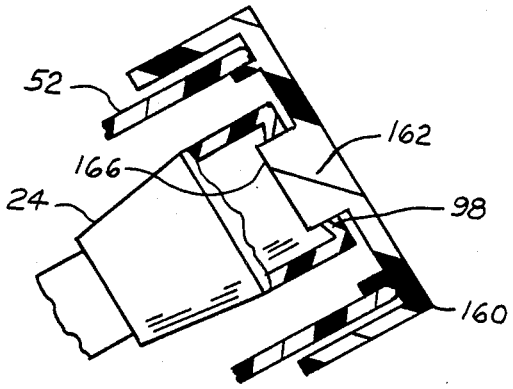
FIGS. 17, 18 and 19 are views similar to FIG. 13 of alternate embodiments.
Figure 17:
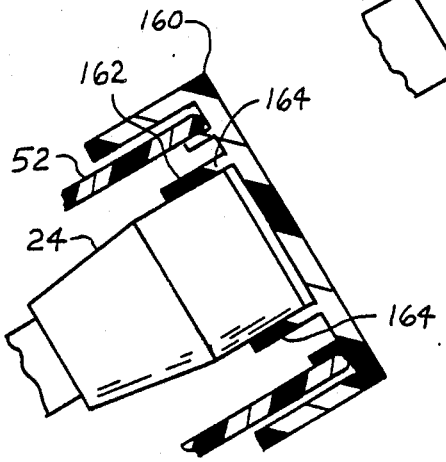
Figure 19:
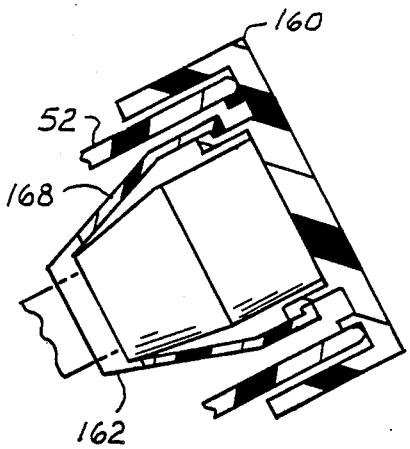

FIGS. 17, 18 and 19 illustrate three alternate embodiments for the retention of inlet fitting 24 in the stowed position. These embodiments contain the feature whereby removal of the closure cap 160 from the fill opening 52 carries the inlet fitting 24 along with it. Indeed the exact manner in which closure cap 160 fits onto filling opening 52 may be any of a number of possible configurations. It may simply snap onto and off of the fill opening; it may have a press fit engagement with the fill opening; or it may have a screw thread engagement, either externally or internally, with the fill opening. The important feature is that closure cap 160 contains a retention means 162 with respect to which inlet fitting 24 has a nominal interference fit. When the inlet fitting 24 is forced into this interference fit, the resilient compressibility of the elastomeric composition of the inlet fitting provides for the resilient retention of the fitting on the closure cap. After the cap has been removed from the fill opening, the inlet fitting is disengaged from the retention means, it can be connected to a faucet. After filling it is re-engaged with the retention means and the cap is placed in closure on the fill opening thereby stowing the fill assist in the process.

In the embodiment of FIG. 17 the retention means 162 is in the form of fingers 164 which project axially inwardly of the fill opening from the endwall of the closure cap, these fingers being integrally formed with the closure cap, and engaging the outside of the inlet fitting.

FIG. 18 illustrates a configuration in which the retention means 162 is still integrally formed with the closure cap endwall but now engages the inlet fitting from the inside. This embodiment portrays the retention means as a post-like structure 166 onto which the inlet end of the inlet fitting is inserted, the resilient lip 98 of the inlet fitting being resiliently deflected.

FIG. 19 portrays a configuration in which the inlet fitting 24 is captured axially with the cap. The capture is by means of a two-part construction in which the retention means 162 is not integrally formed with the closure cap but rather is a separate part 168 having a separable attachment with the closure cap, the two slightly axially conpressing the inlet fitting to hold it on the cap.

Although the embodiments of FIG. 17, 18 and 19 take advantage of the deformable resilient character of the inlet fitting material, it is not always essential that the inlet fitting be held in a resiliently deformed state when supported by the retention means in the stowed position. For example in FIG. 19 where the retention means could still axially capture the inlet fitting on the closure cap but without any axial compression of the inlet fitting. Likewise in the version of FIG. 18 the post-like structure could include a radially outwardly directed projection at its distal end which is of an overall diameter less than the inside diameter of the sidewall of the inlet fitting but greater than the inside diameter of the lip 98. In such a configuration the retention is accomplished by inserting the inlet end of the fitting over the distal end of the post-like structure with lip 98 resiliently deflecting in the process, but inserting the inlet end of the fitting sufficiently far that lip 98 axially clears the radial projection. Use is made of the resilient character of the inlet fitting essentially only to enable the lip to pass the radial projection.

The foregoing has described a new and improved tank fill assist which provides important advantages. The tank fill assist can be conveniently and economically fabricated to provide a useful product for consumers at reasonable cost. As previously noted, it can be sold as a separate accessory for products already in service or it can be purchased with a new product. While the illustrated example for use in filling the tank of a portable toilet has comprised the particular configuration shown, the invention may be embodied in other ways.

What is claimed is:

1. In a liquid carrying tank having a fill opening via which the tank is filled with liquid and which is closed by a removable closure cap, a tank fill assist cooperatively associated with the fill opening to facilitate filling of the tank from an external liquid source and which, when the closure cap is removed, is operable from a stowed position within the tank to a fill assist position for filling of the tank with liquid from the external liquid source and which after filling of the tank is operable back to the stowed position within the tank, said tank fill assist comprising a length of flexible walled conduit having a nominal outside diameter, an inlet fitting on an inlet end portion of said conduit, said inlet fitting having a maximum outside diameter greater than the nominal outside diameter of said conduit but less than a diameter across said fill opening and retainer means disposed on said conduit via which said inlet fitting is supported within said fill opening when the tank fill assist is in the stowed position, and cap retention means on the cap and on the fill opening via which the closure cap is removable retained to close the fill opening with the tank fill assist in the stowed position.

2. A tank fill assist as set forth in claim 1 in which said cap retention means comprises partial screw threads on diametrically opposite side of an inside wall portion of the fill opening and locking tabs on the cap which are cooperatively associable with said partial screw threads to provide for the removable retention of the cap on the fill opening.

3. A fill tank assist as set forth in claim 2 in which said retention means comprises support means for supporting itself in the fill opening via said partial screw threads.

4. A tank fill assist as set forth in claim 3 in which said support means comprises a pair of ring segments on diametrically opposite sides of said retainer means.

5. A tank fill assist as set forth in claim 4 in which said retainer means further includes aperture means organized and arranged to provide a fill path into the tank through the fill opening which is independent of the fill path through said conduit.

6. A tank fill assist as set forth in claim 5 in which said aperture means comprises a pair of apertures on diametrically opposite sides of said retainer means, each of said apertures being in general circumferential registry with a corresponding one of said ring segments.

7. A tank fill assist as set forth in claim 3 in which said inlet fitting comprises an elastomeric material and has an interference fit with said retainer means when said retainer means is supporting said inlet fitting whereby said inlet fitting is retained in resilient compression by its interference fit with said retainer means.

8. A tank fill assist as set forth in claim 7 in which said retainer means further includes aperture means organized and arranged to provide a fill path into the tank through the fill opening which is independent of the fill path through said conduit.

9. A tank fill assist as set forth in claim 8 in which said support means comprises a pair of ring segments on diametrically opposite sides of said retainer means which, with said inlet fitting being supported within said fill opening by said retainer means, are disposed more toward the exterior of the tank than said inlet fitting, said aperture means comprising a pair of apertures on diametrically opposite sides of said retainer means each of which is in general circumferential registry with a corresponding one of said ring segments and each of said pair of apertures extending from the corresponding ring segment in a direction toward the interior of the tank and axially overlapping said inlet fitting.

10. A tank fill assist as set forth in claim 9 in which the axial location of the interference fit of said inlet fitting with said retainer means is more toward the interior of the tank than said apertures.

11. A tank fill assist as set forth in claim 3 in which said retainer means is a generally tubular retainer element of a relatively rigid plastic material having a generally tapered shape which narrows in taper toward the interior of the tank, said retainer element comprising a sidewall which has circularly contoured zones on diametrically opposite sides which are separated by generally flattened zones which are diametrically opposite each other, said generally flattened zones containing apertures organized and arranged to provide a fill path into the tank through the fill opening which is independent of the fill path through said conduit, and said support means comprising a pair of ring segments spanning the flattened zones between the circularly contoured zones, said ring segments being disposed more toward the exterior of the tank than said inlet fitting when the inlet fitting is being supported within said fill opening by said retainer.

12. A tank fill assist as set forth in claim 11 in which said retainer element comprises an internal shoulder and said inlet fitting comprises an elastomeric material and has an interference fit with said shoulder whereby when said inlet fitting is being supported within said fill opening by the retainer element, the inlet fitting is retained in resilient compression by its interference fit with said shoulder.

13. A tank fill assist as set forth in claim 12 in which said retainer element includes a transverse end wall disposed on the retainer element more interiorly of the tank than the interference fit of the inlet fitting with said shoulder, said transverse end wall having a hole through which said conduit passes and said hole having a size which is noticeably larger than the outside diameter of said conduit.

14. A tank fill assist as set forth in claim 1 in which said conduit has an outlet end portion via which liquid flow passes from said conduit into the tank and conduit retention means on said outlet end portion which provides for passage of the outlet end portion through the fill opening and, with the outlet end portion disposed in the tank, is operable to prevent accidental separation of the fill assist from the tank, said conduit retention means comprising flange structure which extends radially of the conduit to have nominally an overall span greater than said diameter of the fill opening for retention and means providing for flexing of said flange structure to an overall span less than the diameter of the fill opening so that the outlet end portion can pass through the fill opening.

15. A tank fill assist as set forth in claim 14 in which said conduit retention means comprises an outlet fitting on said outlet end portion, said outlet fitting comprising a main tubular body having an operative connection with said conduit so that said tubular body oonducts liquid flow from the conduit into the tank, said flange structure comprising flanges projecting radially from diametrically opposite sides of said main tubular body.

16. A tank fill assist as set forth in claim 15 in which one axial end of said main body is inserted into said conduit to form the operative connection between them and said flanges are disposed at the opposite axial end of the main tubular body, said outlet fitting comprising means providing a preferred direction of flexing of said flanges with respect to said main tubular body, said preferred direction of flexing being provided by a radius of curvature which joins the flange structure with the exterior of said main tubular body.

17. In a liquid carrying tank having a fill opening via which the tank is filled with liquid and which is closed by a removable closure cap, a tank fill assist cooperatively associated with the fill opening to facilitate the filling of the tank from an external liquid source and which, when the closure cap is removed, is operable from a stowed position within the tank to a fill assist position for filling of the tank with liquid from the external liquid source and which after filling of the tank is operable back to the stowed position within the tank, said tank fill assist comprising a length of flexible walled conduit having a nominal outside diameter, an inlet fitting on an inlet portion of said conduit, said inlet fitting having a maximum outside diameter greater than the nominal outside diameter of said conduit but less than a diameter across said fill opening, and retainer means acting to support said inlet fitting on said fill opening when the tank fill assist is in the stowed position, said retainer means having a transverse end wall including an aperture through which said conduit passes, and said retainer further having a sidewall extending from said transverse end wall, said sidewall including aperture means between its interior and exterior, said sidewall and its aperture means being organized and arranged to provide a fill path into the tank which is independent of the fill path through said conduit.

18. A tank fill assist as set forth in claim 17 in which said aperture means comprises a pair of apertures on diametrically opposite sides of said sidewall.

19. A tank fill assist as set forth in claim 18 in which said sidewall has circularly contoured zones on diametrically opposite sides which are separated by generally flattened zones which are diametrically opposite each other, each of said generally flattened zones containing a corresponding one of said pair of apertures.

20. A tank fill assist as set forth in claim 17 in which the region of said sidewall which includes said aperture means includes an internal shoulder which is intercepted by said aperture means.

21. A tank fill assist as set forth in claim 17 in which said inlet fitting comprises an elastomeric material and has an interference fit with said sidewall at a location more toward the interior of the tank than said aperture means whereby the inlet fitting is retained in resilient compression by its interference fit with said sidewall.

22. A tank fill assist as set forth in claim 17 in which said conduit has an outlet end portion via which liquid flow passes from said conduit into the tank, and conduit retention means on said outlet end portion which provides for passage of the outlet end portion through the fill opening and, with the outlet end portion disposed in the tank, is operable to prevent accidental separation of the fill assist from the tank, said conduit retention means comprising flange structure which extends radially of the conduit to have nominally an overall span greater than the diameter of the fill opening for retention and means providing for flexing of said flange structure to an overall span less than the diameter of the fill opening so that the outlet end portion can pass through the fill opening.

23. A tank fill assist as set forth in claim 22 in which said conduit retention means comprises an outlet fitting on said outlet end portion, said outlet fitting comprising a main tubular body having an operative connection with said conduit so that said tubular body conducts liquid flow from the conduit into the tank, said flange structure comprises flanges projecting radially from diametrically opposite sides of said main tubular body.

24. A tank fill assist as set forth in claim 23 in which one axial end of said main tubular body of said outlet fitting is inserted into said conduit to form the operative connection between them and said flanges are disposed at the opposite axial end of said main tubular body, said outlet fitting comprising means providing a preferred direction of flexing of said flanges with respect to said main tubular body, said preferred direction of flexing being provided by a radius of curvature which joins the flanges with the exterior of said main tubular body.

25. In a liquid carrying tank having a fill opening via which the tank is filled with liquid and which is closed by a removable closure cap, a tank fill assist cooperatively associated with the fill opening to facilitate filling of the tank from an external liquid source and which is operable, when the closure cap is removed from a stowed position within the tank to a fill assist position for filling the tank with liquid from the external liquid source and which after filling of the tank is operable back to the stowed position within the tank, said tank fill assist comprising a length of flexible walled conduit having a nominal outside diameter which is less than a diameter across said fill opening, said conduit having an outlet end portion which is disposed within the tank and conduit retention means on said outlet end portion which provides for passage of the outlet end portion through the fill opening and with the outlet end portion disposed in the tank is operable to prevent accidental separation of the fill assist from the tank, said conduit retention means comprising flange structure which nominally extends radially of the conduit to have an overall span greater than said diameter of the fill opening for retention and means providing for flexing of said flange structure to an overall span less than the diameter of the fill opening so that the outlet end portion can pass through the fill opening.

26. A tank fill assist as set forth in claim 25 in which said conduit retention means comprises an outlet fitting on said outlet end portion, said outlet fitting comprising a main tubular body having an operative connection with said conduit so that said main tubular body conducts liquid flow from the conduit into the tank, said flange structure comprises flanges projecting radially from diametrically opposite sides of said main tubular body.

27. A tank fill assist as set forth in claim 26 in which one axial end of said main tubular body of said outlet fitting is inserted into said conduit to form the operative connection between them and said flanges are disposed at the opposite axial end of said main tubular body, said outlet fitting comprising means providing a preferred direction of flexing of said flanges with respect to said main tubular body, said preferred direction of flexing being provided by a radius of curvature which joins the flanges with the exterior of said main tubular body.

28. A tank fill assist as set forth in claim 27 in which said flanges present an overall rectangular shape when viewed axially of said main tubular body.

29. In a liquid carrying tank having a fill opening via which the tank is filled with liquid and which is closed by a removable closure cap, a tank fill assist cooperatively associated with the fill opening to facilitate the filling of the tank from an external liquid source and which, when the closure cap is removed, is operable from a stowed position within the tank to a fill assist position for filling the tank with liquid from the external liquid source and which after filling of the tank is operable back to the stowed position within the tank, said tank fill assist comprising a length of flexible walled conduit having a nominal outside diameter, an elastomeric inlet fitting on an inlet end portion of said conduit, said inlet fitting having a nominal maximum outside diameter greater than the nominal outside diameter of said conduit but less than a diameter across said fill opening, and retainer means via which said inlet fitting is positioned at said fill opening when the tank fill assist is in stowed position, said retainer means retaining said inlet fitting in resilient compression.

30. A tank fill assist as set forth in claim 29 in which said inlet fitting joins with said conduit by a union which has serrations at opposite axial ends, said conduit and said inlet fitting being fitted over the serrated ends of said union.

31. A tank fill assist as set forth in claim 30 in which said inlet fitting comprises a neck via which the inlet fitting fits onto said union, said inlet fitting further having a sidewall of larger diameter than said neck projecting from said neck in the direction opposite said union, and the end of said sidewall opposite said neck terminating in a radially inwardly directed circumferencially continuous lip which is canted radially inwardly at an acute angle to said sidewall to present a concave frustoconically tapered surface at the inlet end of said inlet fitting.

32. A tank fill assist as set forth in claim 29 in which said retainer means comprises a part which is separate from the closure cap.

33. A tank fill assist as set forth in claim 32 in which said separate part has a cooperative association with the closure cap in retaining said inlet fitting in resilient compression.

34. A tank fill assist as set forth in claim 29 in which said retainer means is integral with said closure cap.

35. In a walled liquid carrying tank having a fill opening which is integral with the wall of the tank and via which the tank is filled with liquid, a removeable closure for said fill opening and a tank fill assist which is operable to a stowed position within the tank when not in use which is operable to a fill assist position for use to facilitate filling of the tank from an external liquid source, said tank fill assist comprising a length of flexible walled conduit having an elastomeric inlet fitting on an inlet end portion of said conduit, said elastomeric inlet fitting having a size which allows it to be disposed within said fill opening; and retainer means for supporting said elastomeric inlet fitting within said fill opening when the tank fill assist is in stowed position.

* * * * *